US010032372B1

(12) United States Patent
De Nava

(10) Patent No.: US 10,032,372 B1
(45) Date of Patent: Jul. 24, 2018

(54) TRAFFIC SIGNAL SYSTEM

(71) Applicant: Dwayne De Nava, Woodridge, IL (US)

(72) Inventor: Dwayne De Nava, Woodridge, IL (US)

( * ) Notice: Subject to any disclaimer, the term of this patent is extended or adjusted under 35 U.S.C. 154(b) by 0 days.

(21) Appl. No.: 15/584,090

(22) Filed: May 2, 2017

(51) Int. Cl.
*G08G 1/096* (2006.01)
*G08G 1/095* (2006.01)

(52) U.S. Cl.
CPC ..... *G08G 1/096* (2013.01); *G08G 1/095* (2013.01)

(58) Field of Classification Search
CPC ..... G08G 1/096; G08G 1/095
USPC ..... 340/929
See application file for complete search history.

(56) References Cited

U.S. PATENT DOCUMENTS 2,779,932 A 1/1957 Wagner
4,255,737 A 3/1981 Casteel
5,726,648 A 3/1998 Soon
6,268,805 B1 * 7/2001 Simon ..... G08G 1/095 340/309.16
6,331,824 B1 * 12/2001 Firestone ..... G08G 1/096 340/907
D455,365 S 4/2002 Madanat
2002/0005790 A1 * 1/2002 Georgalis ..... G08G 1/096 340/929
2004/0189491 A1 * 9/2004 Aydin ..... G08G 1/096 340/925
2006/0092044 A1 * 5/2006 Naljotov ..... G08G 1/096 340/907
2006/0197684 A1 * 9/2006 Tremblay ..... G08G 1/07 340/909
2007/0176791 A1 * 8/2007 Bolotin ..... G08G 1/096 340/929
2010/0259419 A1 * 10/2010 Renner ..... G08G 1/096 340/929
2017/0124868 A1 * 5/2017 Bhat ..... G08G 1/09623

FOREIGN PATENT DOCUMENTS

WO WO2015161186 10/2015

* cited by examiner

*Primary Examiner* — Zhen Y Wu

(57) ABSTRACT

A traffic signal system includes a traffic light that is positioned at an intersection between roadways thereby facilitating the traffic light to be visible to motorists. A red light emitter is coupled to the traffic light to tell motorists approaching the intersection to stop. A yellow light emitter is coupled to the traffic light to tell the motorists approaching the intersection of an impending red light. A green light emitter is coupled to the traffic light to tell the motorists approaching the intersection to proceed through the intersection. A timer unit is coupled to the traffic light and the timer unit is in communication with each of the green light emitter and the yellow light emitter. The green light emitter emits indicia to communicate a time remaining until the yellow light emitter is turned on. The yellow light emitter emits indicia to communicate a time remaining unit the red light emitter is turned on.

5 Claims, 5 Drawing Sheets

TRAFFIC SIGNAL SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to signal devices and more particularly pertains to a new signal device for incorporating a visible countdown into traffic lights.

BRIEF SUMMARY OF THE INVENTION

An embodiment of the disclosure meets the needs presented above by generally comprising a traffic light that is positioned at an intersection between roadways thereby facilitating the traffic light to be visible to motorists. A red light emitter is coupled to the traffic light to tell motorists approaching the intersection to stop. A yellow light emitter is coupled to the traffic light to tell the motorists approaching the intersection of an impending red light. A green light emitter is coupled to the traffic light to tell the motorists approaching the intersection to proceed through the intersection. A timer unit is coupled to the traffic light and the timer unit is in communication with each of the green light emitter and the yellow light emitter. The green light emitter emits indicia to communicate a time remaining until the yellow light emitter is turned on. The yellow light emitter emits indicia to communicate a time remaining unit the red light emitter is turned on.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
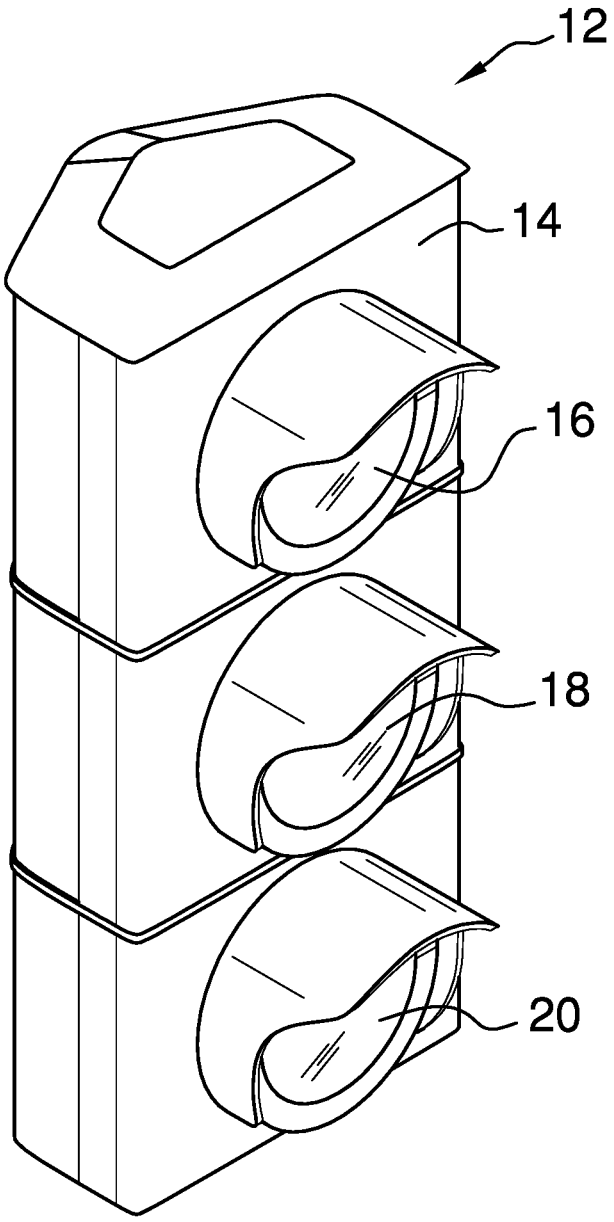
FIG. 1 is a front perspective view of a traffic signal system according to an embodiment of the disclosure.
Figure 2:
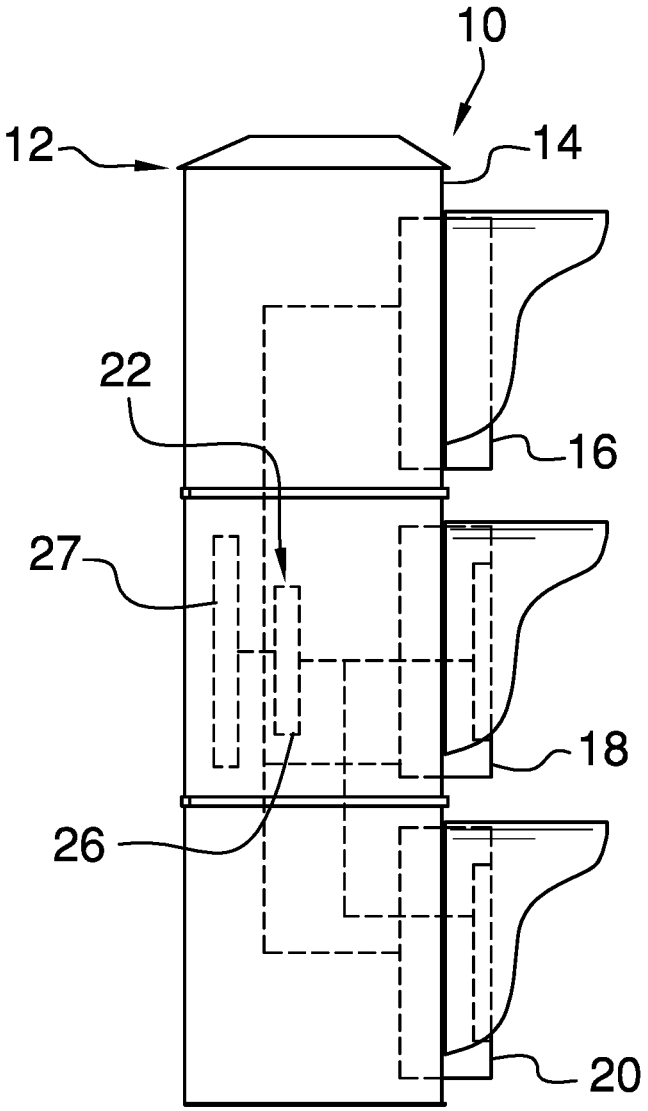
FIG. 2 is a right side phantom view of an embodiment of the disclosure.
Figure 3:
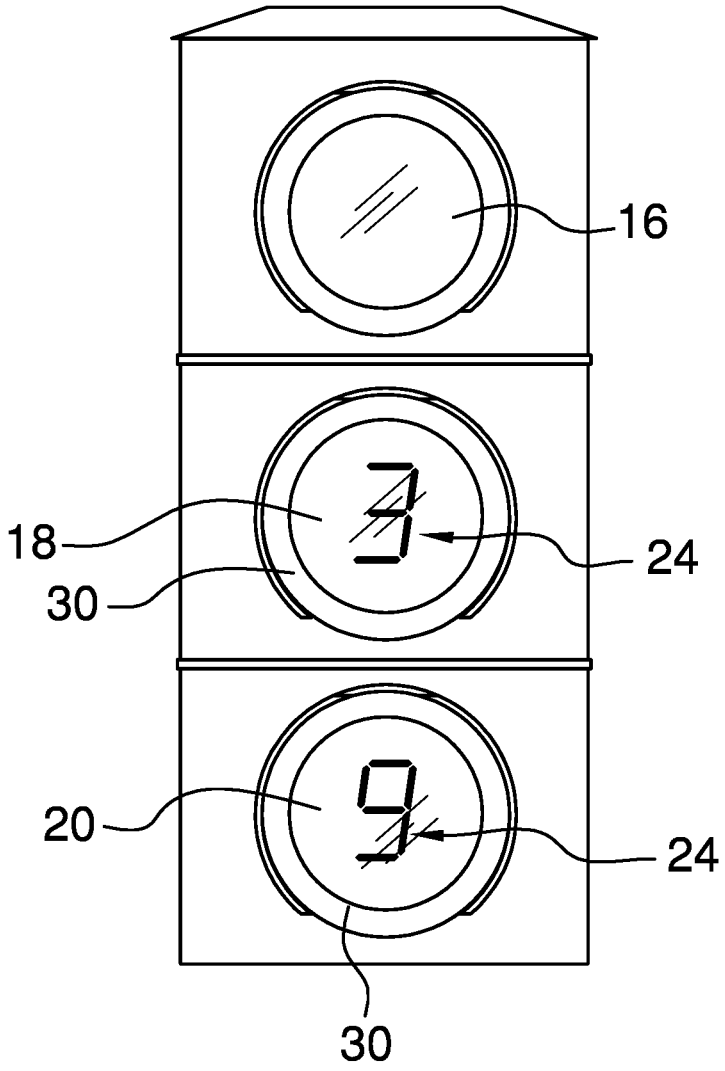
FIG. 3 is a front view of an embodiment of the disclosure.
Figure 4:
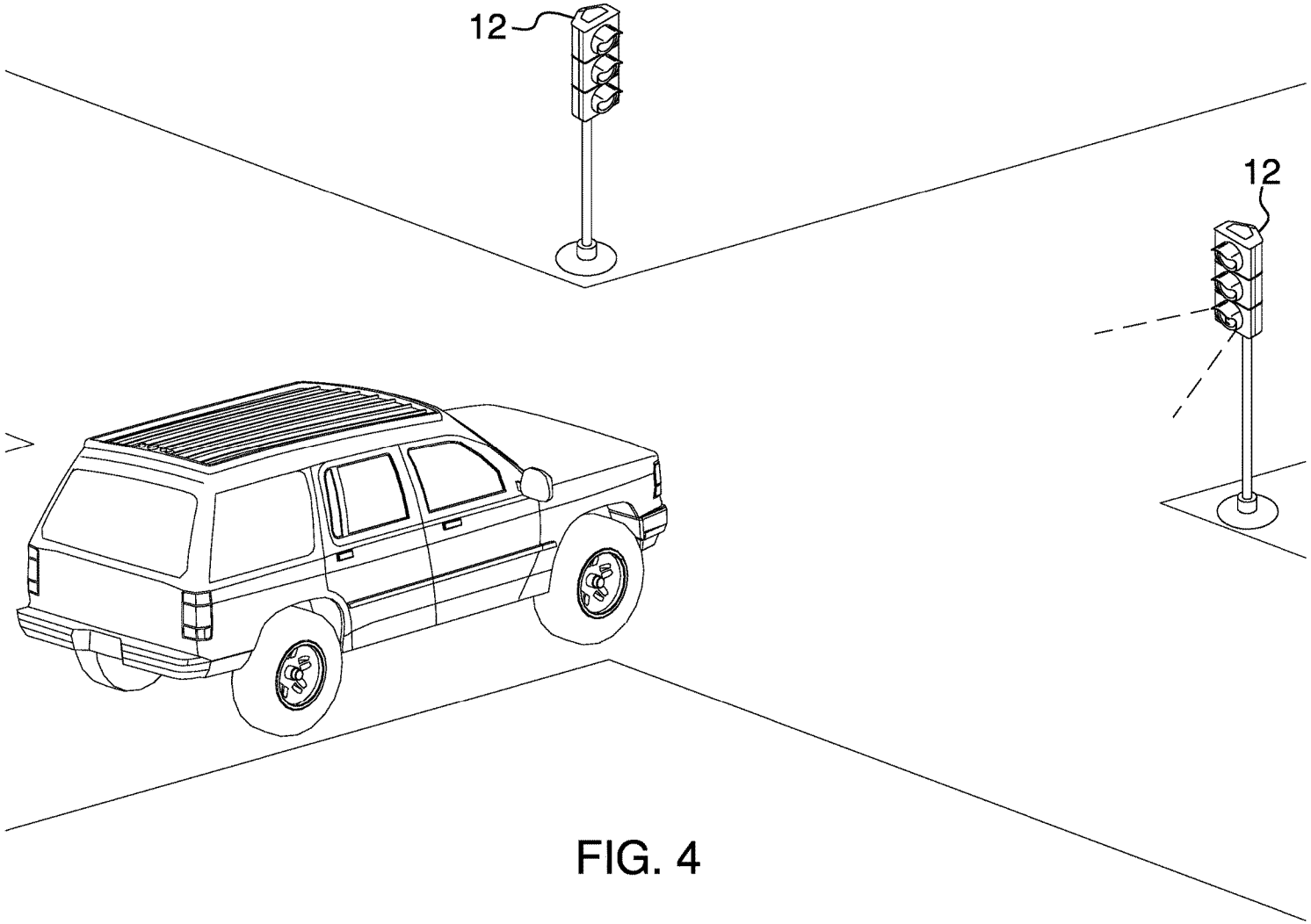
FIG. 4 is a perspective view of an embodiment of the disclosure.
Figure 5:
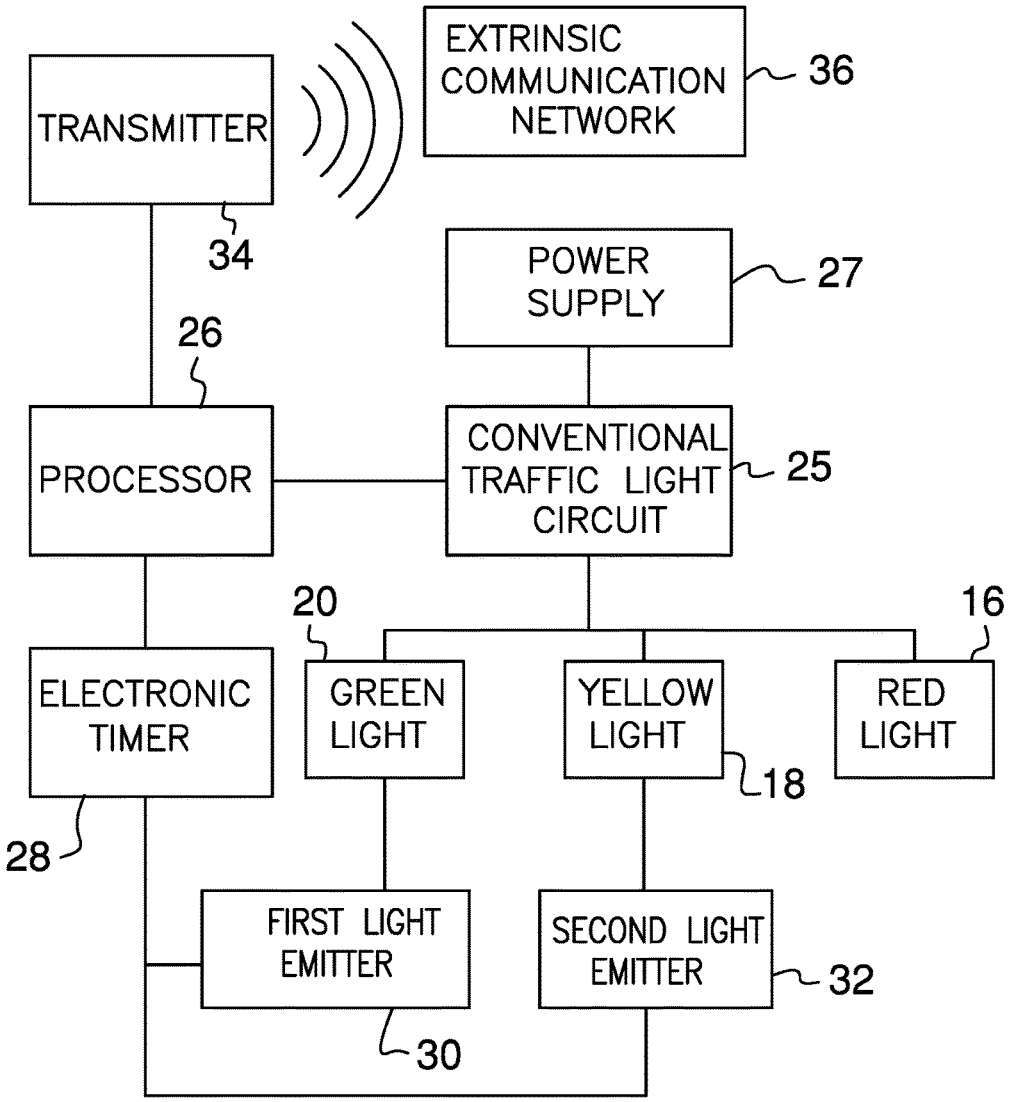
FIG. 5 is a schematic view of an embodiment of the disclosure.

With reference now to the drawings, and in particular to FIGS. 1 through 5 thereof, a new signal device embodying the principles and concepts of an embodiment of the disclosure and generally designated by the reference numeral 10 will be described.

As best illustrated in FIGS. 1 through 5, the traffic signal system 10 generally comprises a traffic light 12 that has a front wall 14. The traffic light 12 is positioned at an intersection of between roadways thereby facilitating the traffic light 12 to be visible to motorists. The traffic light 12 may be an electronic traffic light 12 of any conventional design. A red light emitter 16 is coupled to the front wall 14 of the traffic light 12 to selectively emit red light outwardly therefrom. In this way the red light emitter 16 tells motorists approaching intersection to stop. The red light emitter 16 may be a LED or other light emitter that is capable of emitting indicia as well as a solid color of light.

A yellow light emitter 18 is coupled to the traffic light 12 to selectively emit yellow light outwardly therefrom. In this way the yellow light emitter 18 tells the motorists approaching the intersection of an impending red light. The yellow light emitter 18 is positioned on the front wall 14 below the red light emitter 16. Moreover, the yellow light emitter 18 may be an LED or other light emitter that is capable of emitting indicia as well as a solid color of light.

A green light emitter 20 is coupled to the traffic light 12 to selectively emit green light outwardly therefrom. In this way the green light emitter 20 may tell the motorists approaching the intersection to proceed through the intersection. The green light emitter 20 is positioned on the front wall 14 below the yellow light emitter 18. Additionally, the green light emitter 20 may be an LED or the like that is capable of emitting indicia as well as a solid color of light. Each of the red 16, yellow 18 and green 20 light emitters may be actuated in accordance with municipal traffic laws, state traffic laws and national traffic laws.

A timer unit 22 is provided and the timer unit 22 is coupled to the traffic light 12. The timer unit 22 is in communication with each of the green light emitter 20 and the yellow light emitter 18. Moreover, the timer unit 22 selectively generates a first countdown sequence and a second countdown sequence. The green light emitter 20 emits indicia 24 corresponding to the first countdown sequence. In this way the green light emitter 20 may communicate a time remaining until the yellow light emitter 18 is turned on. The yellow light emitter 18 emits indicia 24 corresponding to the second countdown sequence. In this way the yellow light emitter 18 communicates a time remaining unit the red light emitter 16 is turned on. The timer unit 22 may be a unitary structure with respect to the traffic light 12 and the timer unit 22 may be a retrofitted structure with respect to the traffic light 12.

The timer unit 22 comprises a processor 26 that is positioned within the traffic light 12. The processor 26 is electrically coupled to each of the red light emitter 16, the yellow light emitter 18 and the green light emitter 20. The processor 26 selectively generates the first countdown sequence and the second countdown sequence. Additionally, the processor 26 is electrically coupled to existing control circuitry 25 of the traffic light 12. The processor 26 may be an electronic processor 26 or the like and the existing control circuitry 25 is electrically coupled to a power source 27.

An electronic timer 28 is positioned within the traffic light 12 and the electronic timer 28 is electrically coupled to the processor 26. The electronic timer 28 counts a duration of time corresponding to each of the first countdown sequence and the second countdown sequence. The first countdown sequence may be a duration of time of approximately 5.0 seconds. The second countdown sequence may be a duration of time of approximately 4.0 seconds.

The indicia 24 emitted by the green light emitter 20 may be numbers ranging from 9 to 4 that correspond to the duration of time of the first countdown sequence. Thus, the green light emitter 20 notifies the motorists how much time remains until the yellow light is turned on. The indicia 24 emitted by the yellow light emitter 18 may be numbers ranging from 3 to 1 that correspond to the duration of time of the second countdown sequence. In this way the yellow light emitter 18 notifies the motorists how much time remains until the red light is turned on.

A first light emitter 30 is coupled to the front wall 14 of the traffic light 12 to selectively emit light outwardly therefrom. The first light emitter 30 surrounds the green light emitter 20 and the first light emitter 30 may comprise an LED or the like. The first light emitter 30 is turned on when the processor 26 generates the first countdown sequence. Additionally, the first light emitter 30 may emit light that has a unique color with respect to the green light emitter 20. In this way the first light emitter 30 draws attention to the green light emitter 20 to enhance visibility of the indicia 24 emitted by the green light emitter 20.

A second light emitter 32 is coupled to the front wall 14 of the traffic light 12 to selectively emit light outwardly therefrom. The second light emitter 32 surrounds the yellow light emitter 18 and the second light emitter 32 may comprise an LED or the like. The second light emitter 32 is turned on when the processor 26 generates the second countdown sequence. Moreover, the second light emitter 32 may emit light that has a unique color with respect to the yellow light emitter 18. In this way the second light emitter 32 draws attention to the yellow light emitter 18 to enhance visibility of the indicia 24 emitted by the yellow light emitter 18

A transmitter 34 is positioned within the traffic light 12 and the transmitter 34 is electrically coupled to the processor 26. The transmitter 34 is in electrical communication with an extrinsic communication network 36. In this way the transmitter 34 communicates a status of the first and second countdown sequences. The extrinsic communication network 36 may be a global positioning system, a smart vehicle communication system, a cellular phone communication system, an emergency responder communication network and any other electronic communication network. The transmitter 34 may be a radio frequency transmitter or the like.

The transmitter 34 may be in communication with a smart phone carried by vision impaired users to notify the vision impaired user of the status of the first and second countdown sequences. Thus, the vision impaired user may safely cross the roadway. The transmitter 34 may be in communication with smart vehicles travelling on the roadway. In this way the smart vehicles may appropriately respond to the status of each of the first and second countdown sequences. Additionally, the transmitter 34 may be in communication with emergency vehicles, such as ambulances, fire engines and police cars, to communicate the status of the first and second countdown sequences.

In use, the traffic light 12 is mounted at the intersection of the roadways in the traditional convention of traffic lights. Additionally, the traffic light 12 functions in the same manner of traditional traffic lights. The timer unit 22 facilitates additional functionality to existing traffic lights and newly manufactured traffic lights. The green light emitter 20 displays the indicia 24 corresponding to the first countdown sequence when the green light emitter 20 is turned on. In this way the motorists on the roadway are notified of the time remaining until the yellow light emitter 18 is turned on thereby enhancing roadway safety. The yellow light emitter 18 displays the indicia 24 corresponding to the second countdown sequence when the yellow light emitter 18 is turned on. In this way the motorists on the roadway are notified of the time remaining unit the red light emitter 16 is turned on thereby enhancing roadway safety.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A traffic signal system being configured to communicate a countdown between a green light and a red light, said system comprising:

a traffic light configured to be positioned at an intersection between roadways thereby facilitating said traffic light to be visible to motorists;

a red light emitter being coupled to said traffic light wherein said red light emitter is configured to tell motorists approaching the intersection to stop;

a yellow light emitter being coupled to said traffic light wherein said yellow light emitter is configured to tell the motorists approaching the intersection of an impending red light;

a green light emitter being coupled to said traffic light wherein said green light emitter is configured to tell the motorists approaching the intersection to proceed through the intersection;

a timer unit being coupled to said traffic light, said timer unit being in communication with each of said green light emitter and said yellow light emitter, said timer unit selectively generating a first countdown sequence and a second countdown sequence, said green light emitter emitting indicia corresponding to said first countdown sequence wherein said green light emitter is configured to communicate a time remaining until said yellow light emitter is turned on, said yellow light emitter emitting indicia corresponding to said second countdown sequence wherein said yellow light emitter is configured to communicate a time remaining unit said red light emitter is turned on, said timer unit including a processor being positioned within said traffic light, said processor being electrically coupled to each of said red light emitter, said yellow light emitter and said green light emitter, said processor selectively generating said first countdown sequence and said second countdown sequence, said processor being electrically coupled to control circuitry of said traffic light; and a first light emitter being coupled to a front wall of said traffic light wherein said first light emitter is configured to selectively emit light outwardly therefrom, said first light emitter surrounding said green light emitter, said first light emitter being turned on when said processor generates said first countdown sequence wherein said first light emitter is configured to enhance visibility of said indicia emitted by said green light emitter.

2. The system according to claim 1, further comprising an electronic timer being positioned within said traffic light, said electronic timer being electrically coupled to said processor, said electronic timer counting a duration of time corresponding to each of said first countdown sequence and said second countdown sequence.

3. The system according to claim 1, further comprising a second light emitter being coupled to said front wall of said traffic light wherein said second light emitter is configured to selectively emit light outwardly therefrom, said second light emitter surrounding said yellow light emitter, said second light emitter being turned on when said processor generates said second countdown sequence wherein said second light emitter is configured to enhance visibility of said indicia emitted by said yellow light emitter.

4. The system according to claim 1, further comprising a transmitter being positioned within said traffic light, said transmitter being electrically coupled to said processor, said transmitter being configured to be in electrical communication with an extrinsic communication network thereby facilitating said transmitter to communicate a status of said first and second countdown sequences.

5. A traffic signal system being configured to communicate a countdown between a green light and a red light, said system comprising:

a traffic light having a front wall, said traffic light being configured to be positioned at an intersection of between roadways thereby facilitating said traffic light to be visible to motorists;

a red light emitter being coupled to said traffic light wherein said red light emitter is configured to selectively emit red light outwardly therefrom thereby facilitating said red light emitter to tell motorists approaching intersection to stop, said red light emitter being positioned on said front wall;

a yellow light emitter being coupled to said traffic light wherein said yellow light emitter is configured to selectively emit yellow light outwardly therefrom thereby facilitating said yellow light emitter to tell the motorists approaching the intersection of an impending red light, said yellow light emitter being positioned on said front wall below said red light emitter;

a green light emitter being coupled to said traffic light wherein said green light emitter is configured to selectively emit green light outwardly therefrom thereby facilitating said green light emitter to tell the motorists approaching the intersection to proceed through the intersection, said green light emitter being positioned on said front wall below said yellow light emitter;

a timer unit being coupled to said traffic light, said timer unit being in communication with each of said green light emitter and said yellow light emitter, said timer unit selectively generating a first countdown sequence and a second countdown sequence, said green light emitter emitting indicia corresponding to said first countdown sequence wherein said green light emitter is configured to communicate a time remaining until said yellow light emitter is turned on, said yellow light emitter emitting indicia corresponding to said second countdown sequence wherein said yellow light emitter is configured to communicate a time remaining unit said red light emitter is turned on, said timer unit comprising:

a processor being positioned within said traffic light, said processor being electrically coupled to each of said red light emitter, said yellow light emitter and said green light emitter, said processor selectively generating said first countdown sequence and said second countdown sequence, said processor being electrically coupled to control circuitry of said traffic light, an electronic timer being positioned within said traffic light, said electronic timer being electrically coupled to said processor, said electronic timer counting a duration of time corresponding to each of said first countdown sequence and said second countdown sequence, a first light emitter being coupled to said front wall of said traffic light wherein said first light emitter is configured to selectively emit light outwardly therefrom, said first light emitter surrounding said green light emitter, said first light emitter being turned on when said processor generates said first countdown sequence wherein said first light emitter is configured to enhance visibility of said indicia emitted by said green light emitter, and a second light emitter being coupled to said front wall of said traffic light wherein said second light emitter is configured to selectively emit light outwardly therefrom, said second light emitter surrounding said yellow light emitter, said second light emitter being turned on when said processor generates said second countdown sequence wherein said second light emitter is configured to enhance visibility of said indicia emitted by said yellow light emitter; and a transmitter being positioned within said traffic light, said transmitter being electrically coupled to said processor, said transmitter being configured to be in electrical communication with an extrinsic communication network thereby facilitating said transmitter to communicate a status of said first and second countdown sequences.

* * * * *